US005345370A

United States Patent [19]

Murray et al.

[11] Patent Number: 5,345,370

[45] Date of Patent: Sep. 6, 1994

[54] LAMP OR FLASHLIGHT HAVING A MULTI-FEATURE ROTATING SWITCHING ASSEMBLY

[75] Inventors: Donald W. Murray; Michael C. Story, both of Arlington, Tex.

[73] Assignee: Satelight Technologies, Inc., Cleburne, Tex.

[21] Appl. No.: 986,989

[22] Filed: Dec. 8, 1992

[51] Int. Cl.[5] ..... F21L 7/00

[52] U.S. Cl. ..... 362/205; 362/202; 200/60

[58] Field of Search ..... 362/118, 187, 194, 197, 362/203, 205, 202; 200/60

[56] References Cited

U.S. PATENT DOCUMENTS

| | | | |
|---|---|---|---|
| 1,433,570 | 10/1922 | Stimson | 362/187 |
| 1,884,108 | 10/1932 | Moran . | |
| 1,895,913 | 1/1933 | Buchholz . | |
| 2,020,352 | 11/1935 | Bolduc . | |
| 2,249,689 | 7/1941 | Gelardin . | |
| 2,249,690 | 7/1941 | Gelardin . | |
| 2,259,443 | 10/1941 | Grier | 200/60 |
| 2,261,536 | 11/1941 | Wood | 200/60 |
| 2,373,306 | 4/1945 | Gits . | |
| 2,769,896 | 11/1956 | Lambert | 200/60 |
| 2,797,309 | 6/1957 | Dulberg . | |
| 2,852,632 | 9/1958 | Garland | 200/60 |
| 2,852,633 | 9/1958 | Garland | 200/60 |
| 4,888,670 | 12/1989 | Sharrah . | |
| 4,907,141 | 3/1990 | Wang | 362/197 |
| 4,967,325 | 10/1990 | Shiau | 362/205 |
| 5,006,969 | 4/1991 | Lai . | |
| 5,021,934 | 6/1991 | Hou | 362/187 |
| 5,070,438 | 12/1991 | Marshall . | |
| 5,122,938 | 6/1992 | Pastusek | 362/205 |
| 5,143,441 | 9/1992 | Maglica . | |
| 5,205,640 | 4/1993 | Shin | 362/202 |

*Primary Examiner*—Ira S. Lazarus
*Assistant Examiner*—Y. Quach
*Attorney, Agent, or Firm*—David L. McCombs; Jeffrey M. Becker

[57] ABSTRACT

A lamp or flashlight having a multi-feature switching assembly is disclosed. The flashlight comprises a barrel, a head assembly, and a rotating switching assembly. The head assembly and switching assembly are rotated relative to the barrel and a tongue extending from the barrel to bring a conductor of the switching assembly into contact with, or remove the conductor from contact with, the tongue to close or open an electrical circuit for turning the light bulb on or off, respectively. The conductor may be adapted to nestingly engage the tongue in a locked on position, and a resilient member may be added to nestingly engage the tongue in a locked off position. Unlocked on and off positions of the switching assembly permit the light to be quickly flashed on and off. The head assembly includes a head and a head portion, and the head portion may be rotated relative to the head to adjust the focus of the light independently of the on/off function. Also independently of the on/off function, the head portion may be removed so that the light bulb provides a substantially spherical, unfocused source of light.

14 Claims, 3 Drawing Sheets

LAMP OR FLASHLIGHT HAVING A MULTI-FEATURE ROTATING SWITCHING ASSEMBLY

BACKGROUND OF THE INVENTION

The present invention relates generally to electrical switching systems for lamps and particularly to a flashlight with a multi-feature rotating switching assembly.

Lamps and flashlights of different shapes and sizes and utilizing different on/off switches are well known. Many flashlights utilize a cylindrical tube to carry one or more batteries and to serve as a handle. An electrical circuit is established within the flashlight for passing a current through the filament of a light bulb thereby generating a beam of light. A switch is provided for closing or opening the circuit to place the light bulb in an on or off position, respectively.

Typically, in a flashlight, a center or positive electrode of a battery contacts a conductor which in turn contacts an electrode of a light bulb. The electrode of the light bulb is connected to the filament of the light bulb which is, in turn, connected to another electrode of the light bulb. The second electrode is connected to another conductor. The case or negative electrode of the battery is placed in electrical contact with the cylindrical tube or barrel which is typically made of an electrically conductive material to provide an electrically conductive path to the switch. The switch is used to close or open the circuit, thereby turning the flashlight on or off, respectively.

Switches typically lack a number of desirable features such as the ability to silently turn the flashlight on or off without a clicking sound and the ability to quickly turn the flashlight on and off without placing the switch in an engaged or locked on or off position. The contact points of switches are also typically subject to carbon build-up which diminishes light intensity. In flashlights which are turned on and off by rotating a head assembly relative to a barrel, the switches typically lack locking on and off positions. These switches also typically require excessive degrees of rotation between the on and off positions, thereby making such flashlights difficult to turn on and off using one hand. Additionally, these switches also typically do not permit the user to turn the flashlight off when a head portion of the flashlight is removed to enable the flashlight to be used as a lamp. Finally, flashlights which permit the focus of the light beam to be adjusted by rotating a head assembly relative to a barrel typically do not permit the focus to be adjusted independently of the on/off function. Accordingly, the focus of the beam must be adjusted each time the flashlight is turned on.

SUMMARY OF THE INVENTION

It is therefore an object of the present invention to provide a lamp or flashlight having an improved multi-feature switching assembly.

It is a further object of the present invention to provide a lamp or flashlight which provides for locked on, unlocked on, unlocked off, and locked off positions.

It is a still further object of the present invention to provide a lamp or flashlight which provides for increased control in quickly turning the lamp or flashlight on and off without placing the switch in an engaged or locked on or off position.

It is a still further object of the present invention to provide a lamp or flashlight which may be turned on or off by a small degree of rotation of a head assembly relative to a barrel.

It is a still further object of the present invention to provide a lamp or flashlight which may be silently turned on and off without generating a noticeable clicking sound.

It is a still further object of the present invention to provide a lamp or flashlight which reduces oxidation or carbon build-up at switch contact points.

It is a still further object of the present invention to provide a lamp or flashlight in which, independently of the on/off function, the focus of the beam generated by the light bulb may be quickly and easily adjusted or in which the light bulb may serve as a substantially spherical, unfocused light source, upon removal of a head portion.

Toward the fulfillment of these and other objects, the apparatus of the present invention features a lamp or flashlight having a multi-feature switching assembly. The lamp or flashlight comprises a barrel, a head assembly, and a switching assembly. The switching assembly is rigidly secured to the head assembly, and the switching and head assemblies are rotatably secured to an end of the barrel. The barrel has a tongue extending beyond the end of the barrel. The switching assembly has an insulator and at least one conductor secured within the insulator. The head assembly and switching assembly are rotated relative to the barrel and tongue to bring the conductor into contact with or remove the conductor from contact with the tongue to close or open an electrical circuit which includes a power supply and a light bulb, thereby turning the light bulb on or off, respectively. The conductor may be adapted to nestingly engage the tongue in a locked on position, and a resilient member may be added to nestingly engage the tongue in a locked off position. Unlocked on and off positions permit the light to be quickly flashed on and off. The head assembly may be further divided into a head and a head portion, and the head portion may be rotated relative to the head to adjust the focus of the light independently of the on/off function. Also independently of the on/off function, the head portion may be removed so that the light bulb provides a substantially spherical, unfocused source of light.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
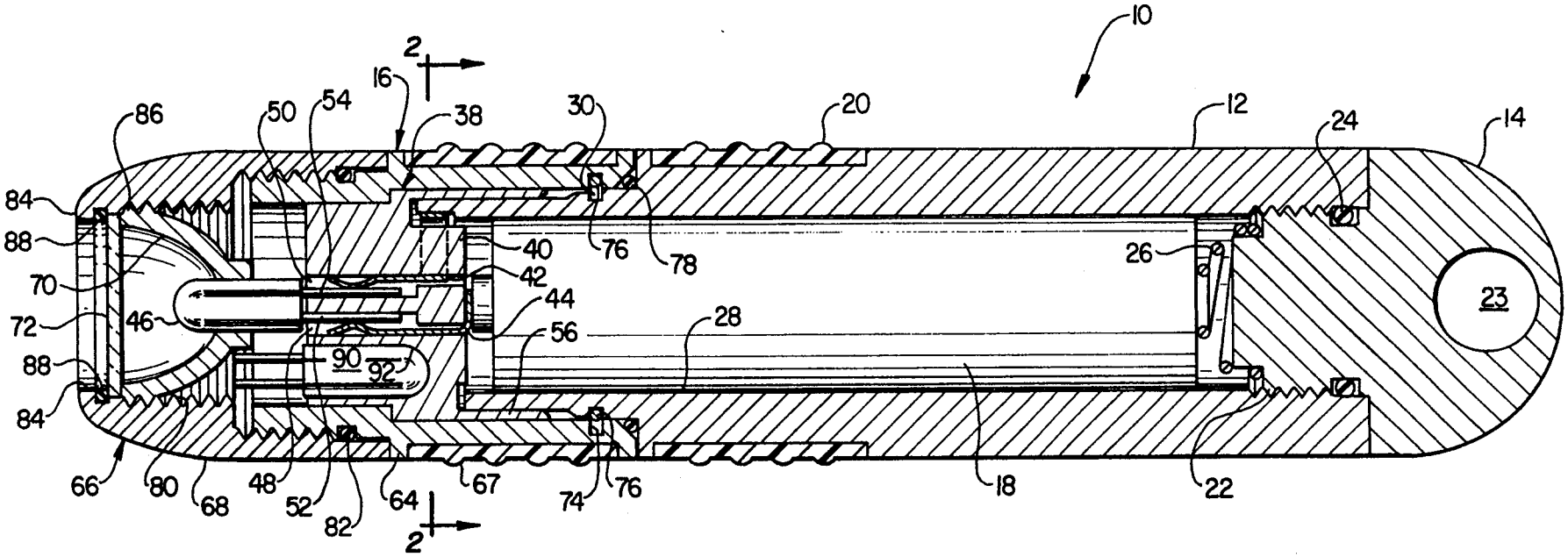
FIG. 1 is an enlarged, elevated, cross-sectional view of a flashlight of the present invention.

In FIG. 1, the reference numeral 10 designates a flashlight incorporating features of the present invention. The flashlight 10 is comprised of a right circular cylinder or barrel 12 enclosed at one end by a tail cap 14 and enclosed at the other end by a head assembly 16.

The barrel 12 may be made of an electrically conductive material and may be configured to hold one or a plurality of batteries 18 disposed in a series arrangement. A grip ring 20 may be secured to or formed integrally with the barrel 12 to facilitate grasping and rotating the barrel. The tail cap 14 may also be made of an electrically conductive material and has a region of external threading 22 which engages matching threads formed on an interior surface of the barrel 12. The tail cap 14 may be provided with an aperture 23 passing therethrough for attachment of such things as a lanyard, a key chain, or a similar device. A sealing element 24, such as an O-ring, may be provided at the interface between the tail cap 14 and the barrel 12 to provide a water-resistant seal. A spring member 26 is secured to the tail cap 14 and extends within the barrel 12 to establish electrical contact between the tail cap 14 and the case electrode of the rearmost battery 18. The spring member 26 also urges the battery or batteries 18 away from the tail cap 14 toward the opposite end of the barrel 12.

Figure 2C:
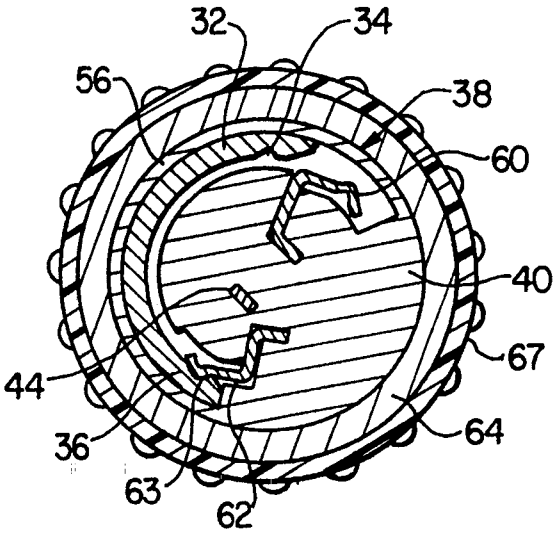
FIGS. 2A, 2B, and 2C are cross-sectional views of the flashlight of FIG. 1 taken along line 2—2, showing the flashlight in a locked on position, an unlocked on position, and a locked off position, respectively.
Figure 2B:
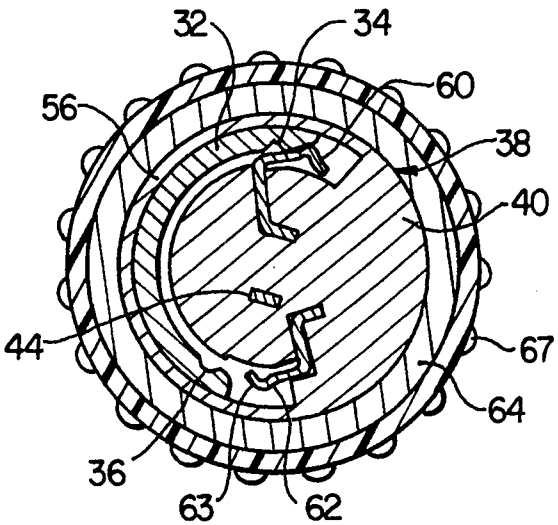
Figure 2A:
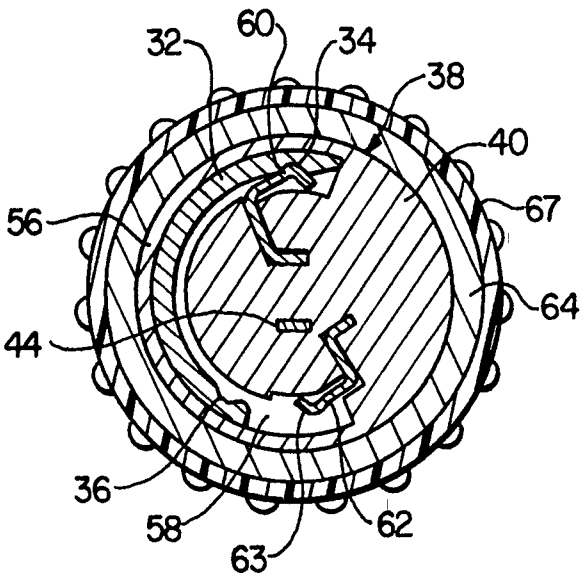
Figure 3:
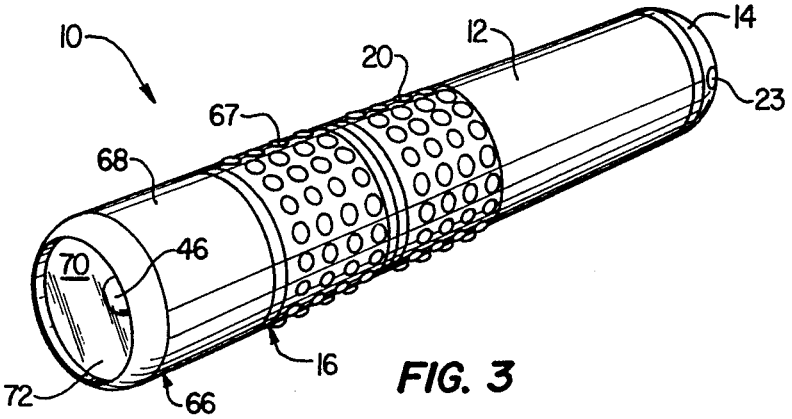
FIG. 3 is an elevated, perspective view of an exterior design of a flashlight of the present invention.
Figure 4:
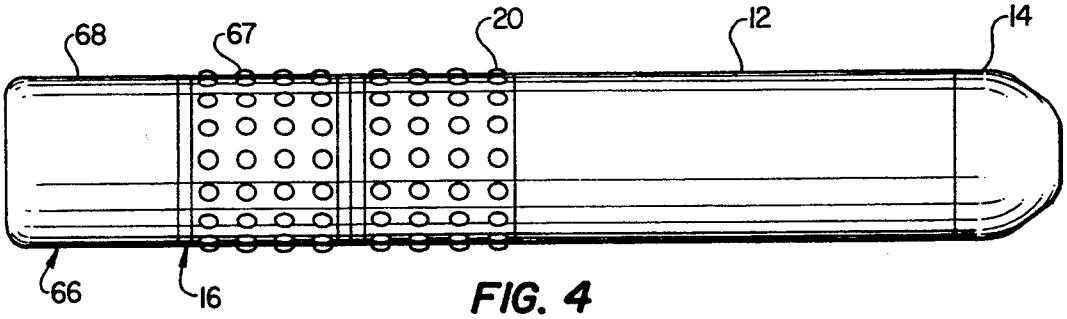
FIG. 4 is a top view of the flashlight of FIG. 3.
Figure 5:
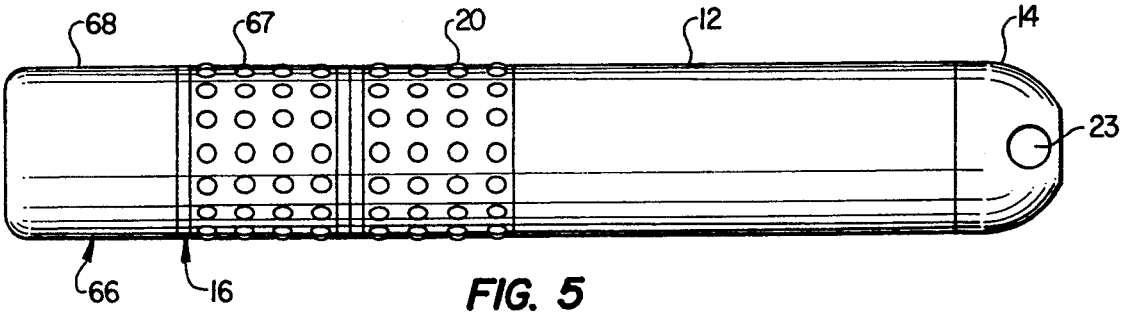
FIG. 5 is a side view of the flashlight of FIG. 3.
Figure 6:
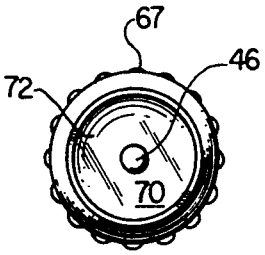
FIG. 6 is a front view of the flashlight of FIG. 3.
Figure 7:
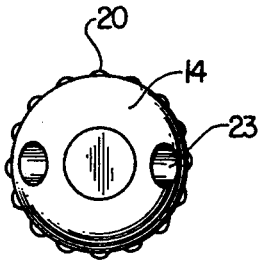
FIG. 7 is a rear view of the flashlight of FIG. 3.

For reasons to be discussed, an end portion 28 of the barrel 12 opposite the tail cap 14 has a reduced diameter. A circumferential groove 30 is formed in the outer surface of the reduced-diameter portion 28, and, as shown in FIGS. 1 and 2A through 2C, the reduced-diameter portion 28 has a segment or tongue 32 which extends beyond the end of the barrel 12. As shown in FIGS. 2A through 2C, two grooves or indentations 34 and 36 are formed in an inner surface of the tongue 32, the grooves 34 and 36 being spaced so that they are near opposite ends of the tongue 32.

A switching assembly, referred to in general by the numeral 38, is disposed at the end of the barrel 12, between the barrel 12 and the head assembly 16. The switching assembly 38 is comprised of an insulator 40 and at least one conductor 42. In the present embodiment, another conductor 44 is provided. The insulator 40 has means for receiving and retaining a light bulb 46, such as two holes 48 and 50 extending through at least a portion of the length of the insulator for receiving and retaining the terminal electrodes 52 and 54 of a bi-pin light bulb 46.

A cylindrical skirt portion 56 of the insulator 40 may be provided to extend over an end portion of the barrel 12 so that it is coaxially aligned with the barrel 12. The skirt portion 56 of the insulator 40 is preferably comprised of a material, such as delrin or teflon, which will provide for smooth rotation of the insulator 40 about the reduced-diameter portion 28 of the barrel 12. An arcuate recess 58 extends through at least a portion of the insulator 40. The recess 58 fits over the tongue 32 of the barrel 12 and is configured to permit a limited degree of rotation of the tongue 32 relative to the insulator 40.

One end of the conductor 44 extends within the hole 48 to contact the terminal electrode 52 of the bulb 46 and to assist in retaining the electrode 52 within the hole by biasing the electrode against a wall of the hole 48. The other end of the conductor 44 extends through the opposite face of the insulator 40 into the battery-containing space of the barrel 12. This end portion of the conductor 44 is positioned to contact a center electrode of a forward battery 18 in the barrel 12.

One end of the other conductor 42 extends within the hole 50 to contact the terminal electrode 54 of the bulb 46 and to assist in retaining the electrode 54 within the hole 50 by biasing the electrode 54 against a wall of the hole 50. The other end portion of the conductor 42 extends within the arcuate recess 58 near an end of the recess 58. The conductor 42 is bent within the recess 58 to provide a spring contact with the tongue 32 when the barrel 12, and therefore the tongue 32, is rotated relative to the switching assembly 38, and therefore the conductor 42, to bring the tongue 32 into contact with the conductor 42. The end portion of the conductor 42 is bent to form a semi-spherical projection 60 which is positioned to mate with and nestingly engage the groove 34 of the tongue 32 when the tongue 32 is rotated to the appropriate location relative to the conductor 42. It is understood that other conventional means for nesting engagement between the tongue and the conductor may also be used. For example, a knob or key may be used rather than bending the conductor to form a projection 60. Also, the conductor 42 could be provided with an indentation of hole, and the tongue 32 could be provided with an engaging projection, knob, or key.

A resilient member 62 may also be disposed within the insulator 40. The resilient member 62 has an end portion that extends within the arcuate recess 58 of the insulator 40 near an end of the recess 58 opposite the conductor 42. The resilient member 62 provides a spring contact with the tongue 32 when the tongue 32 is rotated relative to the insulator 40 to bring the tongue 32 into contact with the resilient member 62. The end portion of the resilient member 62 is also bent to form a semi-spherical projection 63 which is positioned to mate with and nestingly engage the groove 36 of the tongue 32 when the tongue 32 is rotated to the appropriate location relative to the resilient member 62. The resilient member 62 is secured within the insulator 40 to prevent an electrical circuit from being closed through the resilient member 62.

The head assembly 16 comprises a head 64 and a head portion 66 and may include a grip ring 67 secured to or formed integrally with the head 64. The head portion 66 comprises a lens holder 68, a reflector 70, and a lens 72. The head 64 and grip ring 67 extend over and are coaxially aligned with the insulator 40 and the reduced diameter portion 28 of the barrel 12, and the head 64 is rotatably secured to the barrel 12. In the preferred embodiment, the barrel 12 is provided with the reduced diameter portion 28 so that the head assembly 16 may extend over the reduced diameter portion 28 while having substantially the same outer diameter as the barrel 12. The head 64 is preferably secured to the barrel 12 to permit rotation of the head 64 relative to the barrel 12 without axial movement of the head 64 relative to the barrel 12. The insulator 40 and grip ring 67 are both rigidly secured to the head 64 and, accordingly, rotate with the head 64 relative to the barrel 12.

To provide for rotation of the head 64 relative to the barrel 12 without axial movement of the head 64 relative to the barrel 12, a circumferential groove 74 may be formed in the inner surface of the head 64 and aligned with the groove 30 of the barrel 12. A retainer 76 is disposed within the cavity created by the aligned grooves 30 and 74. The retainer 76 secures the head 64 to the barrel 12 and permits rotation of the head 64, grip ring 67, and insulator 40 relative to the barrel 12 without axial movement of the head 64, grip ring 67 and insulator 40 relative to the barrel 12. A sealing element 78, such as an O-ring, may be provided at an interface between the head 64 and the barrel 12 to provide a water-resistant seal.

The lens holder 68 has a region of internal threading 80 which engages matching threads formed on an exterior surface of the head 64. A sealing element 82, such as an O-ring, may be provided at the interface between the lens holder 68 and the head 64 to provide a water-resistant seal. The outermost end of the lens holder has a lip 84 for retaining the lens 72. The reflector 70 is substantially parabolic and includes a region of external threading 86 which engages matching threads formed on an interior surface of the lens holder 68. The lens 72 is held firmly in place between the reflector 70 and the lip 84 of the lens holder 68, and a sealing element 88, such as an O-ring, may be provided at the interface between the lens 72 and the lip 84 to provide a water-resistant seal. The light bulb 46 extends through an aperture in the reflector 70 and may glide in or out of the aperture as the head portion 66 is axially adjusted relative to the head 64, insulator 40, and bulb 46.

In operation, the flashlight is turned on or off by rotating the grip ring 67, and therefore the head 64 and insulator 40, relative to the barrel 12 and the tongue 32. The flashlight 10 may be placed in a locked on position (FIG. 2A), an unlocked on position (FIG. 2B), an unlocked off position, or a locked off position (FIG. 2C).

The flashlight is placed in the locked on position by rotating the grip ring 67 relative to the barrel 12 so that the projection 60 of the conductor 42 nestingly engages the groove 34 in the tongue 32. The flashlight 10 may be placed in the unlocked on position by rotating the grip ring 67 relative to the barrel 12 so that the tongue 32 is in contact with the conductor 42 but the projection 60 of the conductor 42 does not nestingly engage the groove 34.

The flashlight 10 may be placed in the locked off position by rotating the grip ring 67 relative to the barrel 12 so that the projection 63 of the resilient member 62 nestingly engages the groove 36 of the tongue 32. The flashlight 10 may be placed in the unlocked off position by rotating the grip ring 67 relative to the barrel 12 so that the tongue 32 is removed from contact with the conductor 42 but the projection 63 of the resilient member 62 does not nestingly engage the groove 36.

The size of the tongue 32 and the arcuate recess 58 and the placement of the end portion of the conductor 42 and the resilient member 62 within the recess 58 are selected to permit the flashlight 10 to switch from the locked off position to the locked on position with only a small amount of rotation of the grip ring 67 relative to the barrel 12, such as a rotation of approximately 45°. This permits the flashlight 10 to be easily operated using one hand.

The focus of the beam generated by the flashlight may be adjusted independently of the on/off function. The head portion 66 may be rotated relative to the head 64 so that the threaded engagement between the lens holder 68 and the head 64 creates relative axial movement of the head portion 66, including the reflector 70, relative to the head 64, and therefore the light bulb 46. The axial movement of the reflector 70 relative to the light bulb 46 produces an axial shift in the position of the filament of the light bulb 46 relative to a focus of the parabola of the reflector 70, thereby varying the dispersion of the light beam emanating from the light bulb 46 through the lens 72. Additionally, the head portion 66 may be removed from the flashlight, allowing the flashlight to provide a substantially spherical, unfocused source of illumination. Because the reflector 70 is held in threaded engagement with the lens holder 68, the reflector 70 and lens 72 are conveniently retained in place within the head portion 66 when the head portion 66 is removed from the head 64.

The rotation of the head portion 66 relative to the head 64 is independent of the rotation of the grip ring 67, and therefore the head 64 and insulator 40, relative to the barrel 12. Accordingly, a desired focus may be selected and maintained, and the focus need not be readjusted each time the flashlight is turned on. Similarly, the flashlight may be turned on and off even when the head portion 66 is removed from the flashlight.

In one embodiment, sufficient space for storing an extra light bulb 90 may be provided in the cavity formed by the head portion 66, the head 64, and the insulator 40. To supply sufficient space, an additional aperture 92 may be provided in the insulator 40.

FIGS. 3 through 7 show various views of a preferred external design of a flashlight of the present invention.

Several advantages result from the foregoing combination. For example, the present invention discloses a lamp or flashlight having an improved multi-featured switching assembly 35. The locked on and locked off positions are advantageous in that, once the flashlight is placed in the locked on position (FIG. 2A) or the locked off position (FIG. 2C), the flashlight will resist inadvertent rotations that would undesirably turn the flashlight off or on, respectively. The unlocked on (FIG. 2B) and the unlocked off positions permit the user to quickly turn the flashlight on and off without having to overcome the nesting engagement of the locked on or locked off positions. This provides a user greater control and permits the light to be flashed or blinked on and off in quick succession.

Passing the tongue 32 back and forth over the conductor 42 in the manner of the present invention as the flashlight is turned on and off also provides a wiping action that reduces undesirable carbon build-up at the contact point between the tongue 32 and the conductor 42. Such undesirable carbon build-up tends to reduce the light intensity generated by the flashlight.

The present design also eliminates the noticeable clicking noise typically created when a flashlight is turned on or off. The use of the interior tongue 32, the conductor 42, and the resilient member 62 permit the flashlight of the present invention to be silently switched between the locked on, the unlocked on, the unlocked off, and the locked off positions.

Additionally, the focus of the beam may be adjusted independently of the on/off function, and the head portion 66 may be removed without affecting the on/off function of the flashlight.

It is understood that variations may be made in the present flashlight without departing from the scope of the present invention. For example, the barrel 12 and tail cap 14 need not be made of an electrically conductive material as long as an electrically conductive path is provided between the case electrode of the rearmost battery 18 and the tongue 32. Additionally, the present invention is not limited to lamps or flashlights which use batteries 18 as a power supply. The present invention may be practiced using other suitable power supplies as long as means are provided for connecting one electrode of the power supply to the tongue 32 and for connecting the other electrode of the power supply to an electrode of a bulb or to a conductor 44 which, in turn, contacts the bulb.

Further, although it is preferred that the head assembly 16 be rotatably secured to the barrel 12 using a retainer 76, the head assembly 16 may be rotatably secured to the barrel 12 in any conventional manner, such as by threading engagement with the barrel 12. Further still, the insulator 40 need not have an arcuate recess 58. Instead, the conductor 42 may extend from the insulator 40 at any suitable location so that the conductor 42 may be brought into contact with or removed from contact with the tongue 32 by rotating the insulator 40 relative to the barrel 12.

What is claimed is:

1. A flashlight comprising:

a barrel size to accommodate at least one battery, having a distal and proximal end, and having a tongue extending from a portion of said proximal end of said barrel, said tongue having an inner surface and an outer surface, said inner surface having a first groove;

a head assembly adapted to rotatably engage said proximal end of said barrel so that said head assembly is rotatable relative to said barrel without axial movement of said head assembly relative to said barrel; and a switching assembly secured to said head assembly and disposed adjacent said proximal end of said barrel and comprising an insulator having a distal face and a proximal face, and an electrical conductor, at least a portion of said conductor being disposed within said insulator, and said insulator having at least one aperture disposed in said proximal face for receiving a light bulb so that said bulb contacts said conductor;

said insulator having a recess in said distal face for receiving said tongue and permitting rotation of said tongue relative to each insulator when said barrel is rotated relative to said switching assembly, said recess has an inner face and an outer face;

said tongue and said conductor being disposed so that rotation of said switching assembly relative to said barrel enables positioning of said tongue of said barrel in a first position in which said tongue is in contact with said conductor and a second position in which said tongue is removed from contact with said conductor; and said conductor having a first portion that is exposed to said recess so that rotation of said barrel relative to said switching assembly enables rotation of said tongue between said first position in which said tongue is in contact with said first portion of said conductor and said second position in which said tongue is removed from contact with said first portion of said conductor within said recess of said insulator;

wherein, said conductor extends within said recess so that said conductor biases said tongue toward said outer face of said recess and said conductor nestingly engages said first groove when said tongue is placed in contact with said conductor.

2. The flashlight of claim 1 wherein said conductor extends from said inner face of said recess into said recess.

3. The flashlight of claim 1 wherein said recess of said insulator has a first end and a second end and said conductor extends within said recess near said first end of said recess to bias said tongue toward said outer face of said recess when said tongue is rotated near said first end of said recess; and further comprising a resilient member extending from said insulator into said recess near said second end of said recess for biasing said tongue toward said outer face of said recess when said tongue is rotated near said second end of said recess.

4. The flashlight of claim 3 wherein said tongue has first and second ends, said first groove in said tongue being near said first end of said tongue, and said tongue having a second groove near said second end of said tongue so that said resilient member may nestingly engage said second groove of said tongue when said tongue is rotated near said second end of said recess.

5. The flashlight of claim 1 further comprising a second conductor disposed within said insulator so that a proximal end of said second conductor is exposed to said at least one aperture of said insulator for contacting said bulb and so that a distal end of said second conductor extends through said distal face of said insulator for contacting said at least one battery.

6. The flashlight of claim 1 wherein said insulator has a skirt portion which extends over said proximal end of said barrel and between said barrel and said head assembly so that said skirt portion provides for smooth rotation of said barrel relative to said head assembly.

7. The flashlight of claim 1 wherein said head assembly has a head and a head portion which is threadingly engaged with said head.

8. The flashlight of claim 7 wherein said head portion includes a lens and a reflector which are secured to said head portion and said switching assembly is secured to said head so that rotation of said head portion causes relative axial motion between said reflector and said bulb to provide for changing a dispersion of light during operation of said flashlight.

9. The flashlight of claim 8 wherein said head portion has a proximal end, a lip at said proximal end of said head portion, and a threaded inner end near said proximal surface of said head portion, and said reflector has a proximal end and a threaded, outer surface near said proximal end of said reflector, said reflector being threadably secured to said head portion, and said lens being held between said proximal end of said reflector and said lip of said head portion.

10. The flashlight of claim 8 wherein said head assembly and said proximal face of said insulator define a cavity having sufficient space to store a spare light bulb.

11. A lamp comprising:

a barrel having a proximal end;

a switching assembly disposed adjacent to and rotatably engaging said proximal end of said barrel, said switching assembly comprising an insulator, a conductor, a resilient member, means for receiving a light bulb within said insulator, and means for placing a first electrode of said light bulb into electrical contact with a first electrode of a power supply; a first portion of said conductor extending out from said insulator and a second portion of said conductor being disposed within said insulator for contacting a second electrode of said light bulb, a first portion of said resilient member extending out from said insulator in a spaced relationship to said first portion of said conductor, and a second portion of said resilient member being disposed within said insulator; and means for placing said barrel into electrical contact with a second electrode of said power supply;

wherein said switching assembly may be rotated relative to said barrel between a first position in which said first portion of said conductor contacts and nestingly engages a first portion of said proximal end of said barrel to place said lamp in a locked on position and a second portion in which said first portion of said resilient member contacts and nestingly engages a second portion of said proximal end of said barrel to place said lamp in a locked off position.

12. The lamp of claim 11 wherein said switching assembly is rotatably secured to said barrel so that said switching assembly may rotate relative to said barrel without axial movement of said switching assembly relative to said barrel.

13. The lamp of claim 12 further comprising a head assembly rigidly secured to said insulator and rotatably secured to said barrel so that switching assembly may be rotated relative to said barrel by rotating said head assembly relative to said barrel.

14. The lamp of claim 13 wherein said head assembly has an outer diameter substantially equal to an outer diameter of said barrel.

* * * * *

UNITED STATES PATENT AND TRADEMARK OFFICE

CERTIFICATE OF CORRECTION

PATENT NO. : 5,345,370

DATED : September 6, 1994

INVENTOR(S) : Donald W. Murray et al.

It is certified that error appears in the above-indentified patent and that said Letters Patent is hereby corrected as shown below:

Col. 4, line 26, "indentation of" should be --indentation or--.

Col. 7, claim 1, line 44, "each insulator" should be --said insulator--.

Col. 9, claim 11, line 15, "second portion" should be --second position--.

Signed and Sealed this

Twenty-eight Day of February, 1995

*Attest:*

Bruce Lehman

BRUCE LEHMAN

*Attesting Officer*

*Commissioner of Patents and Trademarks*